United States Patent [19]

Nathrath et al.

[11] Patent Number: 4,876,553

[45] Date of Patent: Oct. 24, 1989

[54] APPARATUS FOR ADJUSTING THE POLARIZATION PLANE OF AN ANTENNA

[75] Inventors: Norbert Nathrath, Taufkirchen; Dietmar Fasold, Zorneding, both of Fed. Rep. of Germany

[73] Assignee: Messerschmitt-Bölkow-Blohm GmbH, Munich, Fed. Rep. of Germany

[21] Appl. No.: 277,878

[22] Filed: Nov. 30, 1988

[30] Foreign Application Priority Data

Dec. 1, 1987 [DE] Fed. Rep. of Germany ..... 3740651

[51] Int. Cl.[4] ..... H01Q 13/02; H01Q 3/12

[52] U.S. Cl. ..... 343/756; 343/762

[58] Field of Search ..... 343/756, 761, 763, 786, 343/762; 333/241, 256, 261, 135, 137

[56] References Cited

U.S. PATENT DOCUMENTS

| | | | |
|---|---|---|---|
| 4,222,017 | 9/1980 | Foldes | 333/135 |
| 4,794,400 | 12/1988 | Campora et al. | 343/761 |
| 4,794,401 | 12/1988 | Murashima | 343/761 |

*Primary Examiner*—J. Carroll
*Assistant Examiner*—Michael C. Wimer
*Attorney, Agent, or Firm*—Kenyon & Kenyon

[57] ABSTRACT

A device for adjusting the polarization plane in an antenna feed system is disclosed. The rotary device uses flexible waveguides which permits rotation of the polarization plane over a large angular range.

1 Claim, 1 Drawing Sheet

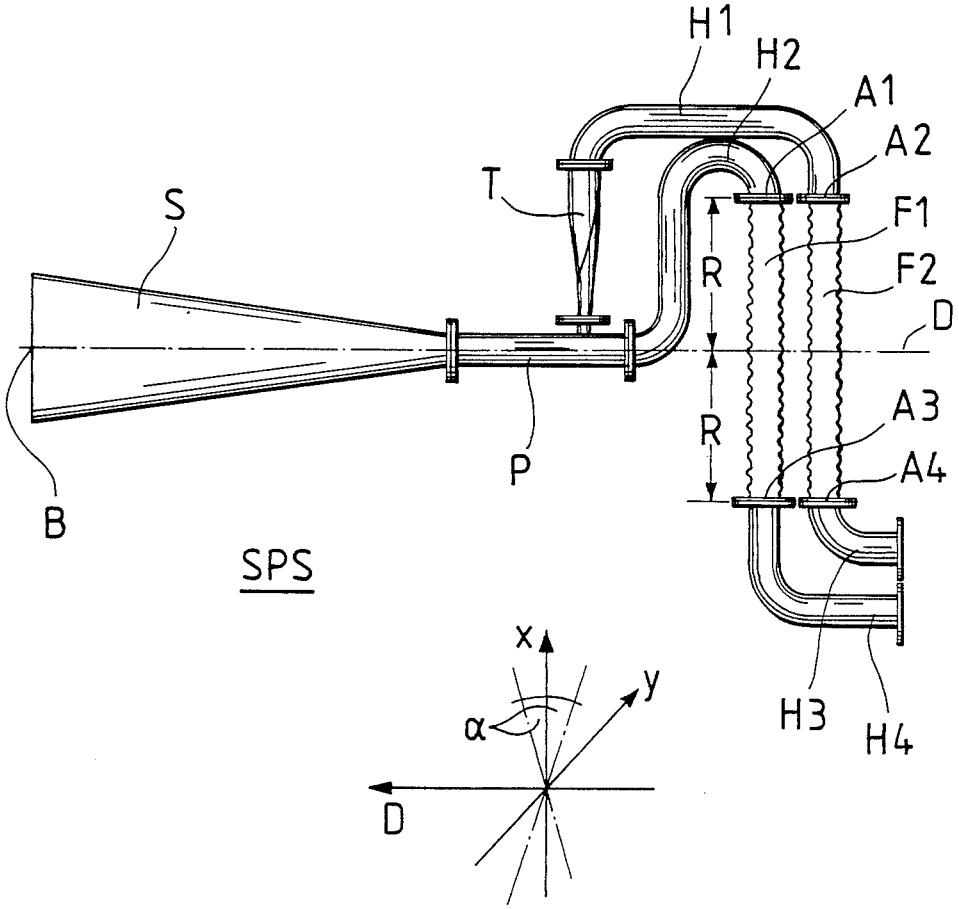
H1
H2
A1
A2
T
S
F1
F2
R
D
R
A3
A4
P
B
SPS
x
y
α
D
H3
H4

APPARATUS FOR ADJUSTING THE POLARIZATION PLANE OF AN ANTENNA

FIELD OF THE INVENTION

The present invention relates to antenna systems and their design. More particularly, it relates to a device for adjusting the polarization plane of an antenna feed system, the feed system being comprised of a feed horn, a orthogonal mode transducer, and feeding waveguides.

BACKGROUND OF THE INVENTION

Antenna feed systems which produce two orthogonally polarized signals are known. When the antenna system's direction of radiation must be changed, it is necessary to adjust the position of the polarization plane. One device used to change the polarization plane is a rotary joint. Although such joints have been used in communications satellites, particularly in direct radiation communications satellites, they are not trouble-free. It is difficult to make such joints pressure-proof, high frequency-proof and tolerant of high breakdown field strengths. When these qualities have been met, the resulting joints have been mechanically complicated and heavy, which qualities are very undesirable for space-based equipment.

It is an object of this invention to provide a device for rotating and adjusting the polarization plane of an antenna feed system which avoids the aforesaid disadvantages of a rotary joint, has good electrical properties, and can be used in direct radiation communications satellites.

SUMMARY OF THE INVENTION

These objects and others are fulfilled by the present invention which is comprised of a rotatably mounted feed horn having an orthogonal mode transducer and at least two partially flexible feeding waveguides arranged perpendicular to the axis of rotation of the feed system. The flanges of the feeding waveguides are aligned in the same cross-sectional area, are located in close proximity to one another, and are arranged at the same distance from the axis of rotation. The flanges of the two fixed relaying waveguides are arranged in the symmetry plane of the feed systems rotation relative to the deflection angle ($\pm\alpha$) and are symmetrical to the flanges of the feeding waveguides at a preset distance from the axis of rotation. The flanges of the feeding waveguides and the flanges of the fixed relaying waveguides are coupled together by flexible waveguides which permit movement about the axis of rotation.

This arrangement offers a number of advantages. The components used results in a very small total weight. The closed waveguide system has very low insertion losses, a low reflectance and is high frequency- and pressure-proof. The transmittable power of the system is limited only by the breakdown field strength of the waveguides. The design also prevents passive intermodulation products and "multipacting" (secondary electrons-dynamic multiplication). The problem of waveguide components twisting relative to each other is also avoided.

These and other objects and advantages of the invention will appear more closely from the following specification, in which:

BRIEF DESCRIPTION OF THE DRAWING

The FIGURE shows a feed system with two orthogonal polarization planes and a device for rotating the polarization planes. The angle of rotation $\alpha$ is indicated in the coordinate system.

DETAILED DESCRIPTION

Referring to the FIGURE, waveguide legs $H_1/H_3$ and $H_2/H_4$, coupled together by flexible waveguides $F_1$ and $F_2$, feed the two inputs of orthogonal mode transducer P. Transducer P is coupled to feed horn S, which radiates or receives signals polarized orthogonally to one another.

Antenna feed system SPS, which is comprised of feed horn S, orthogonal mode transducer P and waveguide sections $H_1$ and $H_2$ coupled to orthogonal mode transducer P, is rotatably mounted relative to axis of rotation D, which is the same as main beam direction B of feed horn S. This enables feed system SPS to rotate about axis of rotation D over a certain range on either side of a center line X in the X,Y plane, as shown, to provide the given polarization directions.

Flanges $A_1$ and $A_2$ of feeding waveguides $H_1$ and $H_2$ are arranged so that they move on a circular path at a distance R around the axis of rotation D. The apertures of flanges $A_1$ and $A_2$ have the same cross-section and are in roughly the same location. One of the feeding waveguides is coupled to orthogonal mode transducer P with twist T. The position of flanges $A_1$ and $A_2$ is not critical. They may be side by side, one behind the other, in the E-plane or in the H-plane. The FIGURE shows the optimum placements.

Symmetrical to axis of rotation D at distance R, flanges $A_3$ and $A_4$ of relaying waveguides $H_3$ and $H_4$ are fastened. Flanges $A_3$ and $A_4$ have the same cross-sectional area as each other and flanges $A_1$ and $A_2$. Although symmetry of position of the flange pairs relative to each other is not mandatory, an asymmetrical arrangement would cause problems with respect to the bending behavior of flexible waveguides $F_1$ and $F_2$ which are used to couple flanges $A_1$ to $A_3$ and $A_2$ to $A_4$. The flexible waveguides, which are an important element of the present invention, are commercially available and have been qualified for use in outer space previously. When R is a small distance, the angle of rotation $\alpha$ attainable by feed system SPS using these flexible waveguides is $\pm 45°$. In principle this allows any desired position of the polarization plane (when using both available polarization planes) to be used. If only a single polarization plane is used, a larger angle of rotation $\alpha$, $\pm 90°$, is attainable. This would require increasing distance R accordingly, as the smallest possible bending radius of the flexible waveguides must be taken into account.

In the foregoing specification, the invention has been described with reference to specific exemplary embodiments thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. Apparatus for rotatably adjusting the polarization plane in an antenna feed system, the feed system having an axis of rotation, comprising:

rotatable feed horn means having a main beam direction coincident with the axis of rotation of the feed system;

orthogonal mode transducer means coupled to the feed horn means;

at least two movable feeding waveguide means coupled to the orthogonal mode transducer means, the feeding waveguide means having at least two moving flange means aligned in the same plane in close proximity to one another, and arranged at an equal distance from the axis of rotation of the feed system;

at least two fixed relaying waveguide means arranged at the same distance from the axis of rotation as the movable feeding waveguide means, the fixed relaying waveguide means having fixed flange means aligned in the same plane, the fixed flange means being in close proximity to one another, said two fixed relaying waveguide means being arranged along an axis of symmetry of the feed system which is substantially disposed perpendicular to said axis of rotation; and flexible waveguide means coupled respectively to the fixed and moving flange means, the flexible waveguide means being capable of rotation through angles of $\pm\alpha$ on either side of said axis of symmetry.

* * * * *